US005406654A

United States Patent [19]

Antoine

[11] Patent Number: 5,406,654

[45] Date of Patent: Apr. 18, 1995

[54] HYDRODYNAMIC MASSAGE DEVICE

[75] Inventor: Robert Antoine, Varennes-Vauzelles, France

[73] Assignees: Andre Belilty, Elancourt; Robert Decup, Puteaux, both of France; part interest to each

[21] Appl. No.: 137,029

[22] PCT Filed: Apr. 10, 1992

[86] PCT No.: PCT/FR92/00322

§ 371 Date: Dec. 21, 1993

§ 102(e) Date: Dec. 21, 1993

[87] PCT Pub. No.: WO92/18087

PCT Pub. Date: Oct. 29, 1992

[30] Foreign Application Priority Data

Apr. 17, 1991 [FR] France ..... 91 04718

[51] Int. Cl.[6] ..... A61H 33/02

[52] U.S. Cl. ..... 4/541.4; 4/541.1; 4/541.6

[58] Field of Search ..... 4/492, 541.1, 541.2, 4/541.3, 541.4, 541.5, 541.6

[56] References Cited

U.S. PATENT DOCUMENTS

| | | | |
|---|---|---|---|
| 953,529 | 3/1910 | Higgins | 4/492 |
| 2,237,435 | 4/1941 | Ille | 4/541.4 |
| 2,587,335 | 2/1952 | Landergott | 4/541.4 |
| 3,797,482 | 3/1974 | Nicollet | 4/541.4 |
| 4,339,833 | 7/1982 | Mandell | 4/541.4 X |

FOREIGN PATENT DOCUMENTS

| | | | |
|---|---|---|---|
| 0168823 | 1/1986 | European Pat. Off. . | |
| 2382888 | 10/1978 | France . | |
| 0154935 | 9/1985 | France | 4/541.3 |
| 2630911 | 11/1989 | France . | |
| 2314349 | 9/1973 | Germany . | |

*Primary Examiner*—Robert M. Fetsuga
*Attorney, Agent, or Firm*—Young & Thompson

[57] ABSTRACT

The device comprises a bathtub (2), injection orifices (5) associated with supply devices (12, 20) for producing hydrodynamic jets directed interiorly of the bathtub (2), and control units (22, 25, 27) for orienting in a synchronized manner the hydrodynamic jets issuing from the injection orifices (5) disposed on side surfaces (3, 4) of the bathtub (2). The control units are arranged such that, when they downwardly orient a hydrodynamic jet issuing from an injection orifice disposed on one side surface of the bathtub, they simultaneously upwardly orient a hydrodynamic jet issuing from an injection orifice disposed on the opposite side surface of the bathtub, and vice versa.

15 Claims, 7 Drawing Sheets

HYDRODYNAMIC MASSAGE DEVICE

FIELD OF THE INVENTION

The present invention concerns a hydrodynamic massage device. More particularly, the device according to the invention comprises a bathtub and injection orifices associated with supply means for producing hydrodynamic jets directed interiorly of the bathtub.

BACKGROUND OF THE INVENTION

The patient who is to receive the massage is positioned in the bathtub filled with water and the hydrodynamic jets issued from injection orifices massage the body of the patient. By "hydrodynamic jets" is meant jets of water under pressure, the water having been recovered via outlets situated at the base of the bathtub, it being possible to emit these water jets at the same time as jets of blown air. In this type of device, the known embodiments are distinguished from one another by the more or less significant number of injectors distributed at the base and about the periphery of the bathtub and by the possibilities of varying the pressure or the flow rate of the hydrodynamic jets. Nevertheless, the possibilities for varying the characteristics of the hydrodynamic massage as a function of the treatment to be applied are relatively few with the known devices.

In particular, there are known from the documents FR-A-2 382 888 and FR-A-2 630 911, hydrodynamic massage devices comprising a bathtub and injection nozzles distributed on two opposite surfaces of the bathtub and producing hydrodynamic jets which are oriented by suitable control means. But according to these documents, the control movements of the injection nozzles are effected in essentially horizontal planes, and therefore do not permit simulating the enveloping movements performed by masseurs and kinesitherapists.

SUMMARY OF THE INVENTION

The object of the present invention is to overcome these disadvantages by proposing a new hydrodynamic massage device having great adaptability to practice massages and that permit substantially reproducing the massage movements performed by professionals.

The invention also proposes a hydrodynamic massage device, comprising a bathtub, injection orifices associated with supply means for producing hydrodynamic jets directed interiorly of the bathtub, and control means for orienting in a synchronized manner the hydrodynamic jets issuing from the injection orifices disposed on opposed lateral surfaces of the bathtub.

According to the invention, this device is characterized in that the control means are provided such that, when they upwardly orient a hydrodynamic jet issuing from an injection orifice disposed on one lateral surface of the bathtub, they simultaneously downwardly orient a hydrodynamic jet issuing from an injection orifice disposed on the opposite lateral surface of the bathtub, and vice versa.

By providing a synchronized adjustment of the orientation of the hydrodynamic jets, the present invention permits adapting the hydrodynamic massage to the particular needs of the patient. The synchronized control of the orientations permits causing the hydrodynamic jets to describe sweeping movements. These sweeping movements generally reproduce the effect of a manual massage, contrary to the known devices in which the hydrodynamic jets remain localized on the same parts of the body. The oriented hydrodynamic jets thus produce the desired massaging rolling contact around the body of the patient.

According to an advantageous embodiment of the invention, each hydrodynamic jet oriented by the control means remains substantially parallel to a respective vertical plane inclined relative to the longitudinal direction of the bathtub, such that the hydrodynamic jets are oriented interiorly of the bathtub and towards the side where in use is situated the head of the patient stretched out in the bathtub.

The hydrodynamic jets thus ascend from the feet toward the head of the patient, with a sweeping motion parallel to the inclined vertical plane. Upon contacting the body of the patient, they thus produce a massage which compensates the muscular forces opposing gravity.

In a first embodiment according to the invention, the supply means comprise orientable injectors placed in injection orifices disposed on the lateral surfaces of the bathtub. The control means may thus comprise an articulated transmission mechanism for orienting in a synchronized manner these orientable injectors.

According to a second embodiment of the invention, the supply means comprise, for each injection orifice situated on a lateral surface of the bathtub, at least two fixed injectors of different orientations, and the control means comprise selection means for selectively controlling the flow of a hydrodynamic jet in one of the fixed injectors of each injection orifice.

BRIEF DESCRIPTION OF THE DRAWINGS

Other characteristics of the advantages of the present invention will appear from the following description of embodiments, read in conjunction with the accompanying drawings, in which.

DETAILED DESCRIPTION OF THE INVENTION

Figure 1:
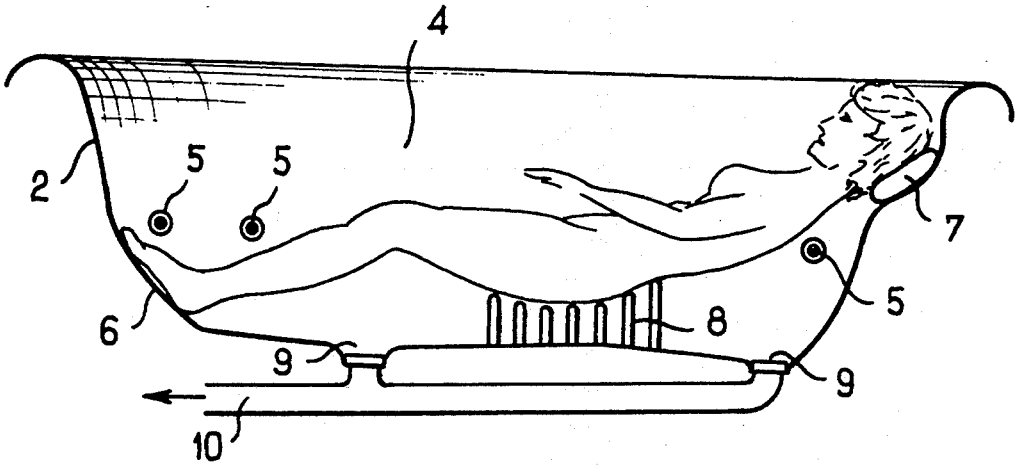
FIG. 1 is a side view of a bathtub forming part of a hydrodynamic massage device according to the invention.

In FIG. 1, there is shown a patient situated in a bathtub 2 forming part of a device according to the invention. Injection orifices 5 are disposed on the side surfaces of the bathtub 2 to produce hydrodynamic jets directed interiorly of the bathtub 2. For receiving the patient in the bathtub 2, this latter comprises supports 6, 7 receiving respectively the feet and the head of the patient, as well as a tubular seat 8 disposed at the level of the buttocks of the patient. The tubular seat 8 is sufficiently high to permit the hydrodynamic jets to circulate beneath the body of the patient. At the base of the bathtub 2 are provided anti-vortex outlets 9 for recovering the water from the bathtub, this water being aspirated by a pump (not shown) through the intermediary of a tub 10 communicating with the outlets 9. The pump thus aspirates the water of the bathtub 2 for the reinjection thereof at the level of the lateral injection orifices 5.

Figure 2:
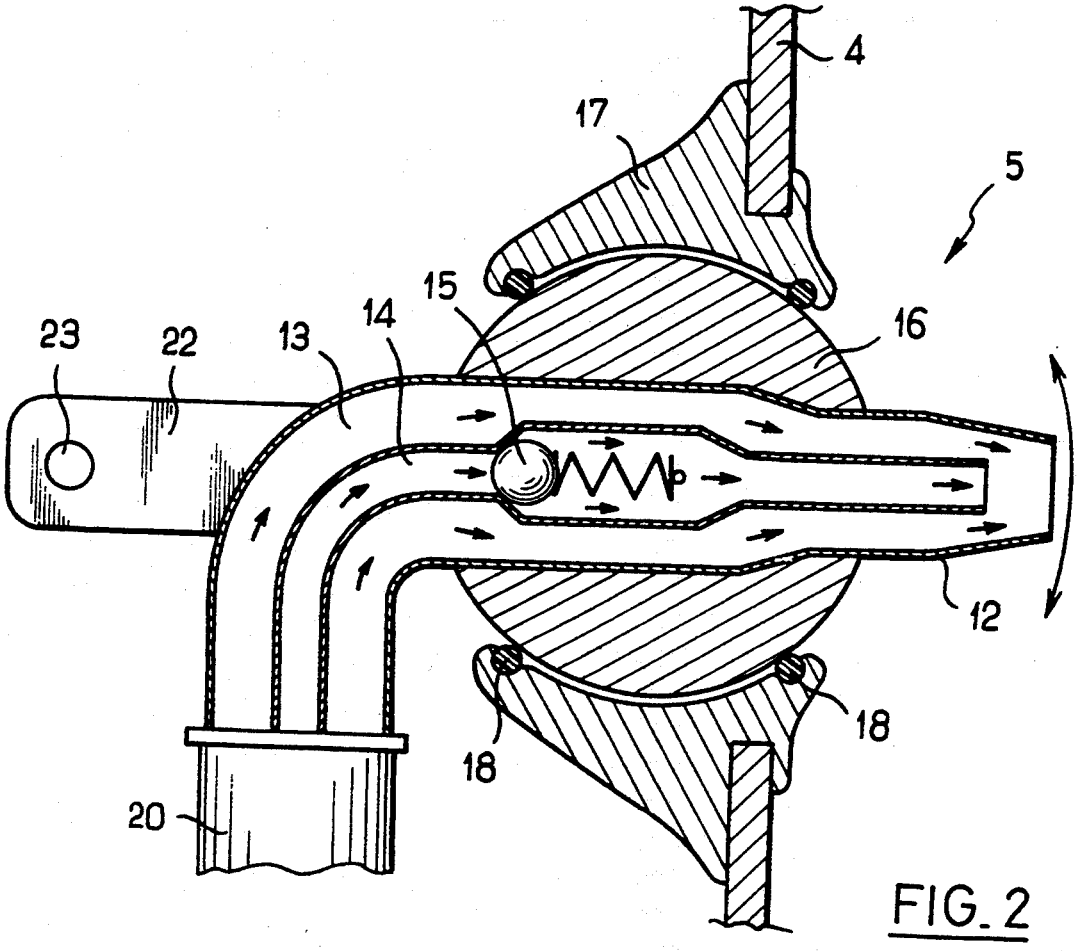
FIG. 2 is a sectional view of an injector that may be used in the present invention.

FIG. 2 shows a sectional view of an orientable injector 12 placed in an injection orifice 5 disposed on a side face 4 of the bathtub 2. The orientable injector 12 comprises two coaxial tubes 13, 14 for injecting interiorly of the bathtub 2 water conveyed under pressure by the pump, and air that has optionally been reheated. The central tube 14, intended for the circulation of air, is provided with a non-return valve 15 intended to prevent reflux of water from the bathtub into the air injection tube 14.

The orientable injector 12 is positioned in the injection orifice 5 by a sealed swivel joint mounting. The injector 12 traverses a spherical body 16 housed in a corresponding seat 17 integrated with the side surface of the bathtub 2. Two O-rings 18 are interposed between the spherical body 16 and its seat 17 to assure the water-tightness of the injection orifice 5. A flexible tube 20 connects the injector 12 to the pump.

It can be seen in FIG. 2 that the rear portion of the injector 12 comprises a shank 22 supporting an articulation axis 23 that permits controlling the orientation of the injector 12 as will be explained below.

Figure 3:
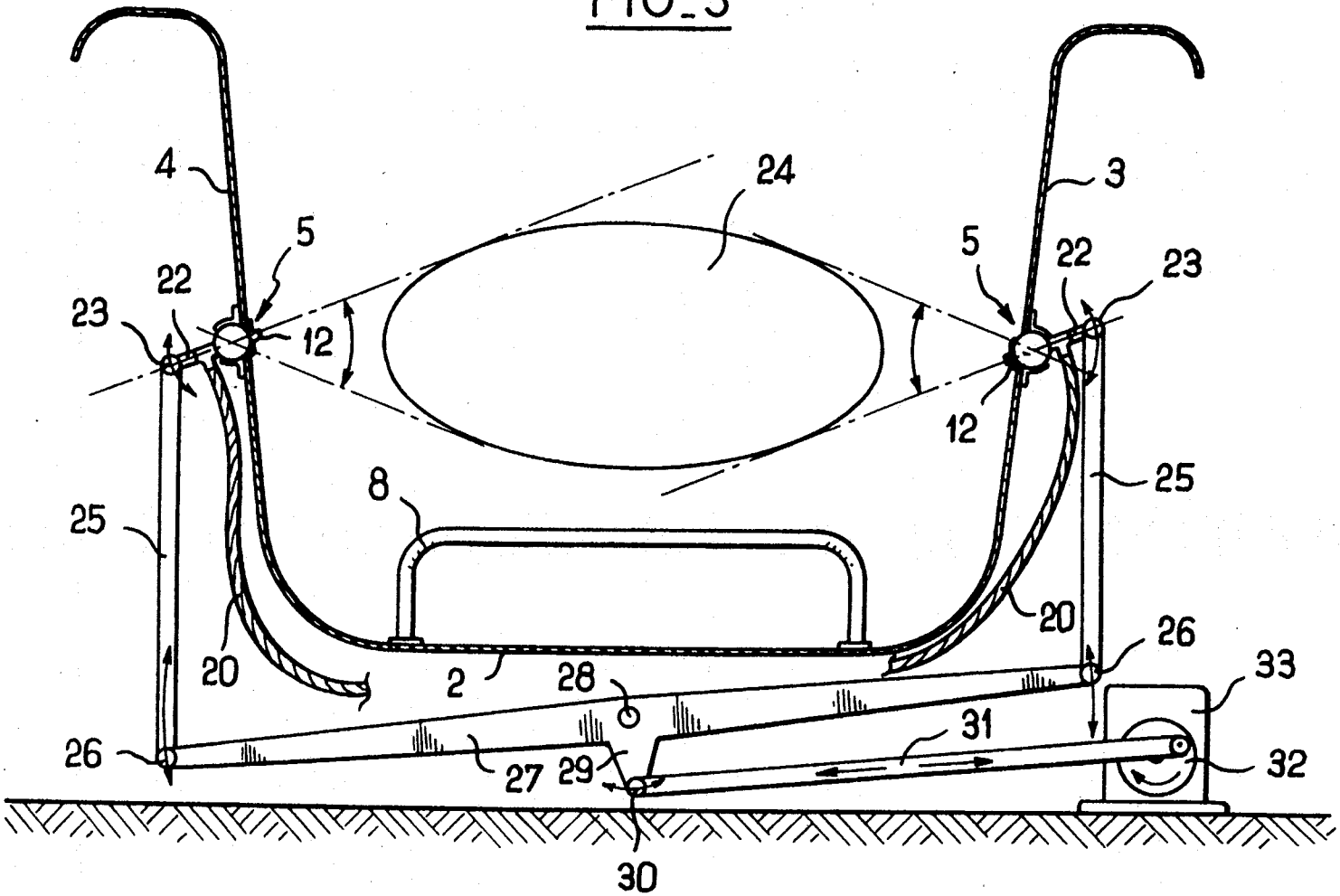
FIG. 3 is a schematic view in transverse section of an embodiment of the invention.

In FIG. 3, which illustrates a first embodiment of the invention, there are shown control means provided for orienting in a synchronized manner the hydrodynamic jets issuing from the injection orifices 5 disposed on the opposed side surfaces 3, 4 of the bathtub 2. These control means comprise a link transmission mechanism for guiding the orientable injectors 12 disposed on the opposed side surfaces 3, 4 of the bathtub 2. Each orientable injector 12 is connected to a link 25 articulated on the axis 23 provided at the rear of the orientable injector 12. The links 25 extend substantially vertically behind the side surfaces 3, 4 of the bathtub 2, and their lower ends are articulated, at 26, to a lever 27 extending beneath the bathtub 2, perpendicular to its longitudinal direction. In FIG. 3, the oval 24 schematically represents a transverse section of the figure of the patient stretched out in the bathtub 2.

Figure 4:
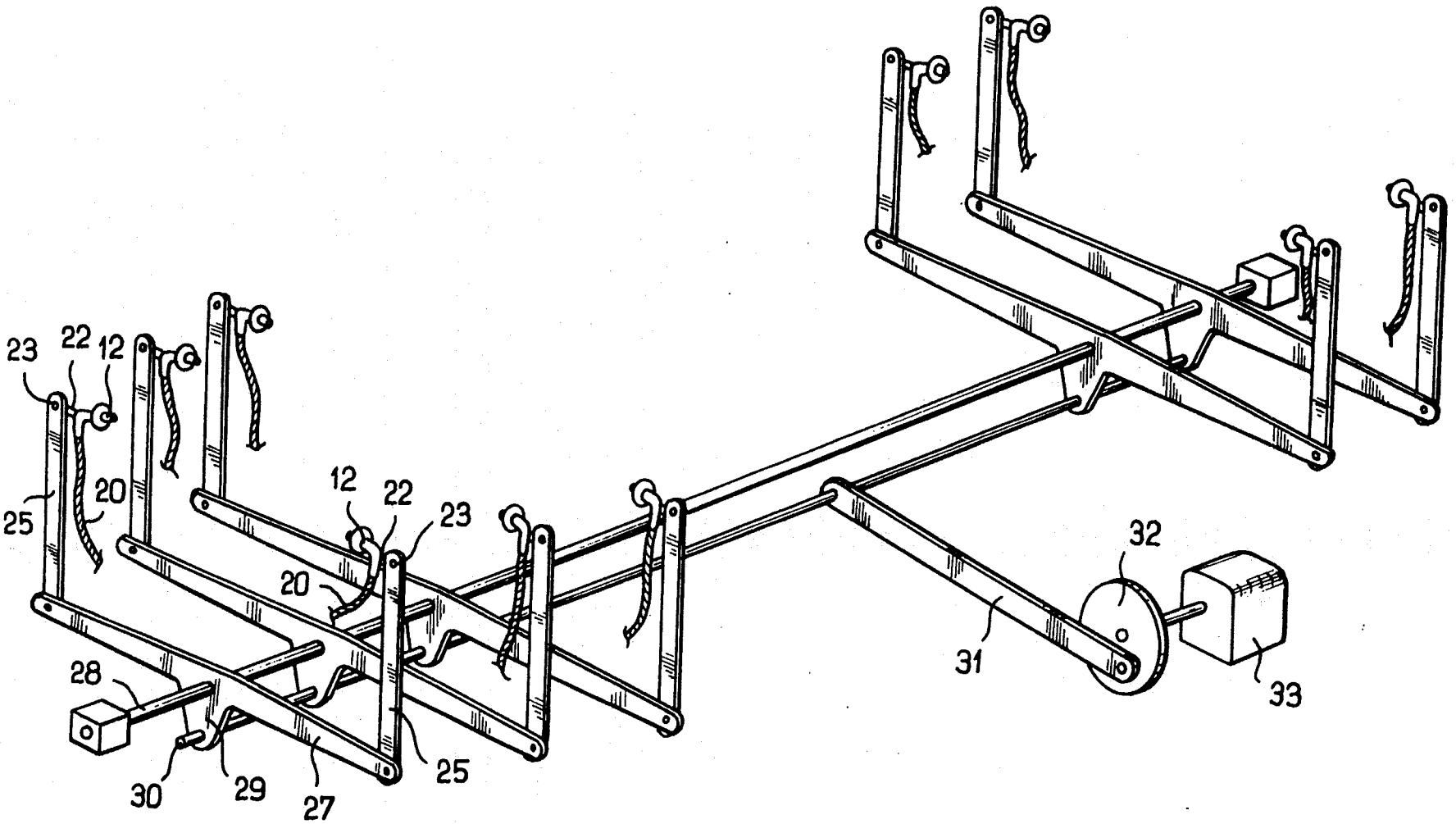
FIG. 4 is a perspective view of the transmission mechanism used in the embodiment of FIG. 3.

In the perspective view of FIG. 4, the bathtub 2 is not shown, so as to reveal the transmission mechanism. The orientable injectors 12 are associated in pairs corresponding to the injection orifices 5 disposed on the opposite side surfaces 3, 4 of the bathtub in a substantially symmetrical manner relative to the longitudinal direction of the bathtub. To preserve the clarity in FIG. 4, the five pairs of orientable injectors 12 are not shown. To each pair of injectors 12 corresponds a lever 27 connected to the two respective links 25 and pivotally mounted in its middle on a central fixed shaft 28, parallel to the longitudinal direction of the bathtub 2. Below the central shaft 28, each lever 27 comprises a flange 29 on which is mounted a common actuating bar 30 parallel to the central shaft 28. A drive link 31 mounted in an eccentric position on a rotating disc 32 driven in rotation by a motor 33 is articulated to the actuating bar 30. Thus, rotation of the disc 32 causes an oscillating movement of the levers 27, which is translated into alternating upward and downward orientations of the orientable injectors 12.

As illustrated in FIG. 3, when an orientable injector 12 disposed on one side surface of the bathtub 2 is oriented upwardly, the link transmission mechanism ensures that the paired injector 12 situated on the opposite side surface 3 of the bathtub 2 is oriented downwardly of the bathtub, and vice versa. During this operation of the device, rotation of the disc 32 communicates up-and-down movements to the links 25, which are translated into sweeping motions by the hydrodynamic jets issued from the injection orifices 5.

Figure 6:
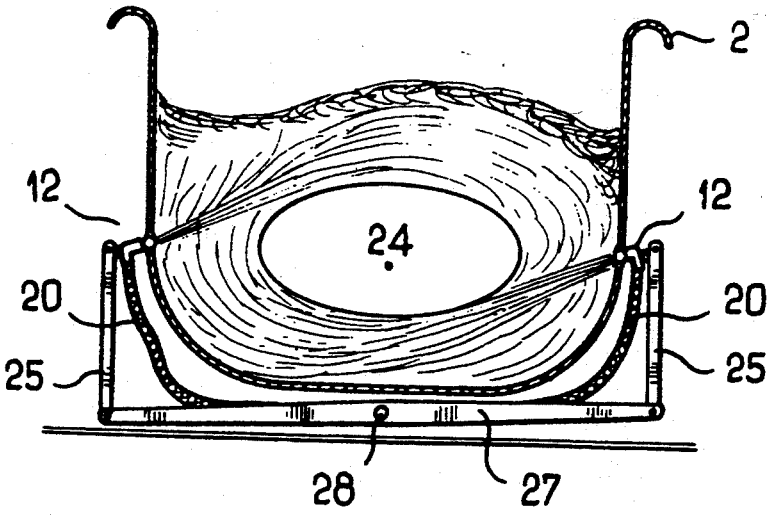
FIGS. 5 to 7 are schematic views in transverse section illustrating the operation of the device shown in FIGS. 3 and 4.
Figure 5:
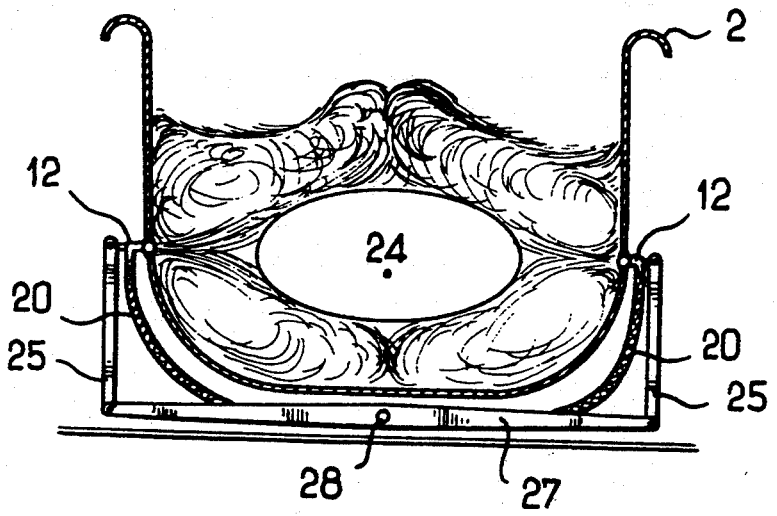
Figure 7:
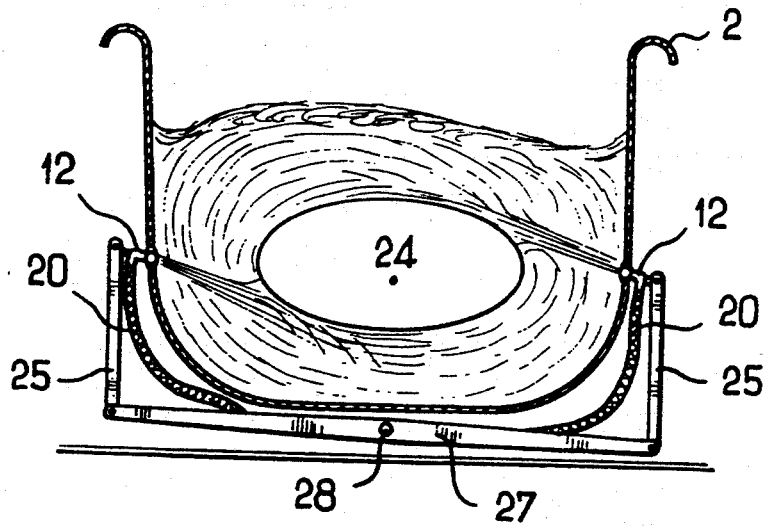

This sweeping motion is illustrated in three positions in FIG. 5 to 7. In the position shown in FIG. 5, the lower lever 27 is horizontal and the hydrodynamic jets are directed horizontally toward the sides of the patient. In the two extreme positions of the sweeping motion, illustrated in FIGS. 6 and 7, the conjugated orientations of the injectors 12 situated on either side of the bathtub 2 are such that massaging hydrodynamic rolling motions are formed around the body of the patient.

Figure 8:
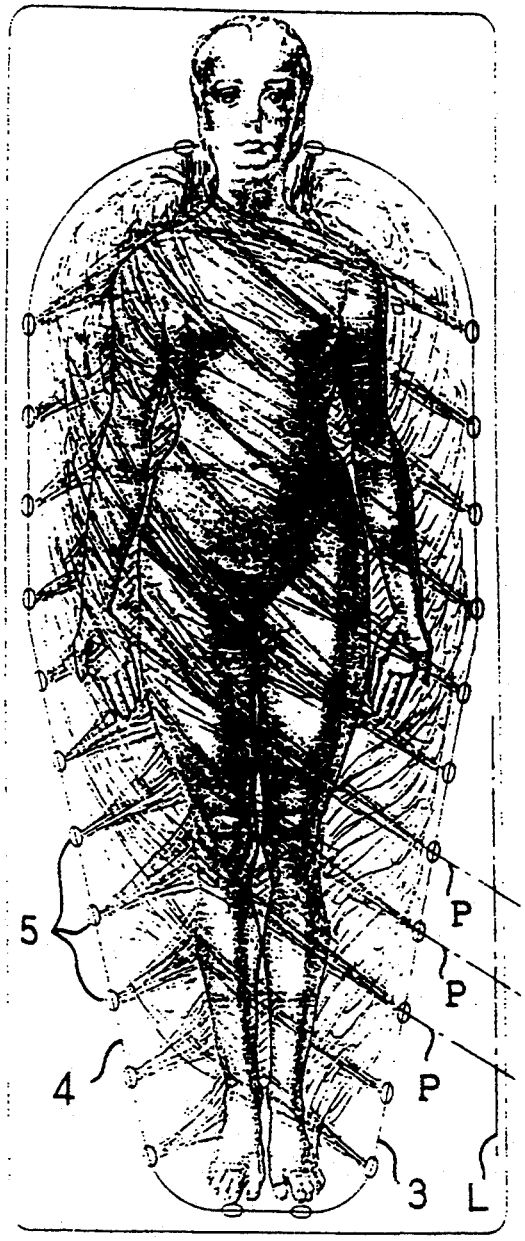
FIGS. 8 and 9 are views from above, illustrating the operation of the device shown in FIGS. 3 and 4.
Figure 9:
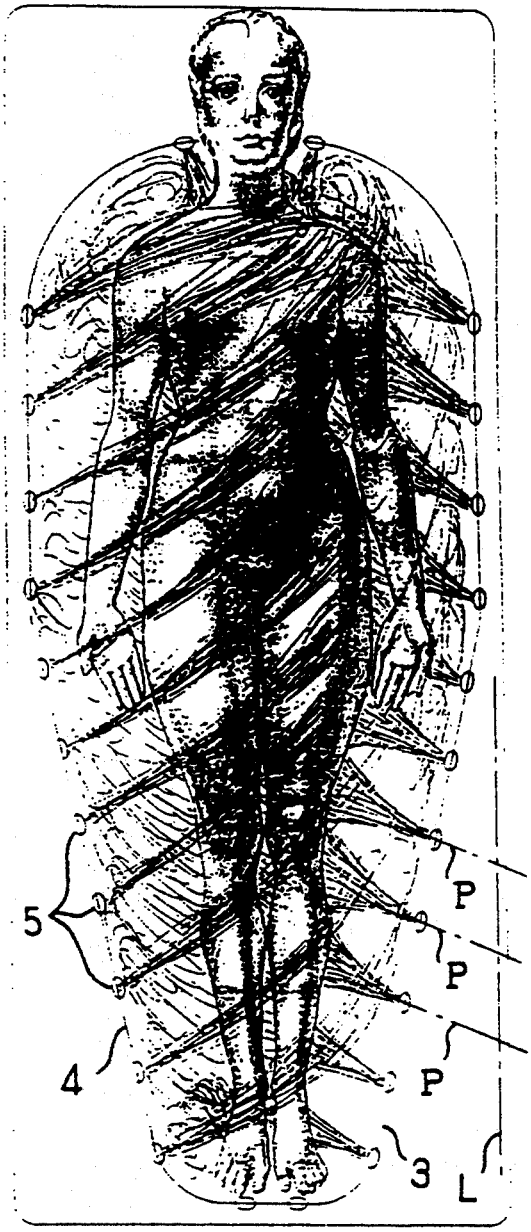

The two extreme positions illustrated in FIGS. 6 and 7 are also shown from above in FIGS. 8 and 9. In the course of the sweeping motion, each oriented hydrodynamic jet remains substantially parallel to a respective vertical plane P, thanks to a corresponding disposition of the orientable injectors 12 in their respective injection orifices 5. As is shown in FIGS. 8 and 9, each of these vertical planes P is inclined relative to the longitudinal direction L of the bathtub 2, such that the oriented hydrodynamic jets issuing from the injection orifices 5 are directed interiorly of the bathtub 2 and toward the side where is situated the head of the patient stretched out in the bathtub. This inclination of the plane P of the oriented jets provides a hydrodynamic massage which tends to ascend from the feet toward the head of the patient.

In the extreme positions shown in FIGS. 6 to 9, the oriented hydrodynamic jets produce massaging rolling motions of an overall counter-rotating helicoidal shape about the body of the patient. These rolling motions faithfully and very gently reproduce the enveloping movements performed by professional masseurs. The sweeping motion between these two extreme positions of the injectors provides a hydrodynamic massage of very good quality.

Figure 10:
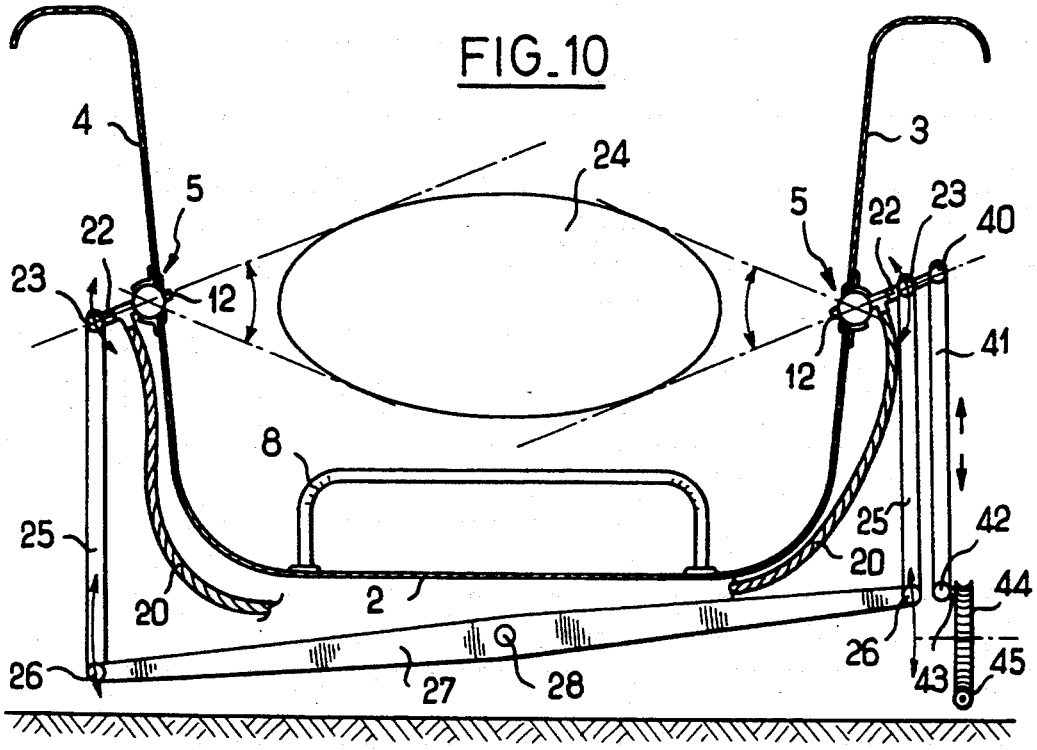
FIG. 10 is a transverse sectional view of a second embodiment of the invention.

FIG. 10 is a view similar to that of FIG. 3, showing a second embodiment of the present invention. The same reference numerals in FIGS. 3 and 10 designate the same elements in the two embodiments. These elements will not be described again for the second embodiment. In the second embodiment, actuation of the link transmission mechanism 25 and levers 27 is not effected by an actuation device common to all the levers 27, but is effected independently for each lever 27. The injectors 12 of each pair of orientable injectors may thus be oriented in a synchronized manner independently of the other pairs, which permit advantageously varying the sequences of the hydrodynamic massage. For each pair of orientable injectors 12, the shank 22 situated at the rear of the injectors 12 extends beyond the articulation 23 with the link 25, up to a second swivel joint articulation 40. A control link 41 has its upper end mounted on the swivel joint 40 and at its lower end articulated by a swivel joint 42 to a finger 43 disposed in an eccentric position on a toothed annulus 44. The toothed annulus 44 meshes with a helicoidal motor pinion 45. The rotation of the motor pinion 45 causes the eccentric finger 43 to turn, which transmits through the intermediary of the control link 41 an up-and-down motion to the transmission mechanism formed of the links 25 and lever 27, so as simultaneously to orient the orientable injectors 12 of each pair.

Figure 11:
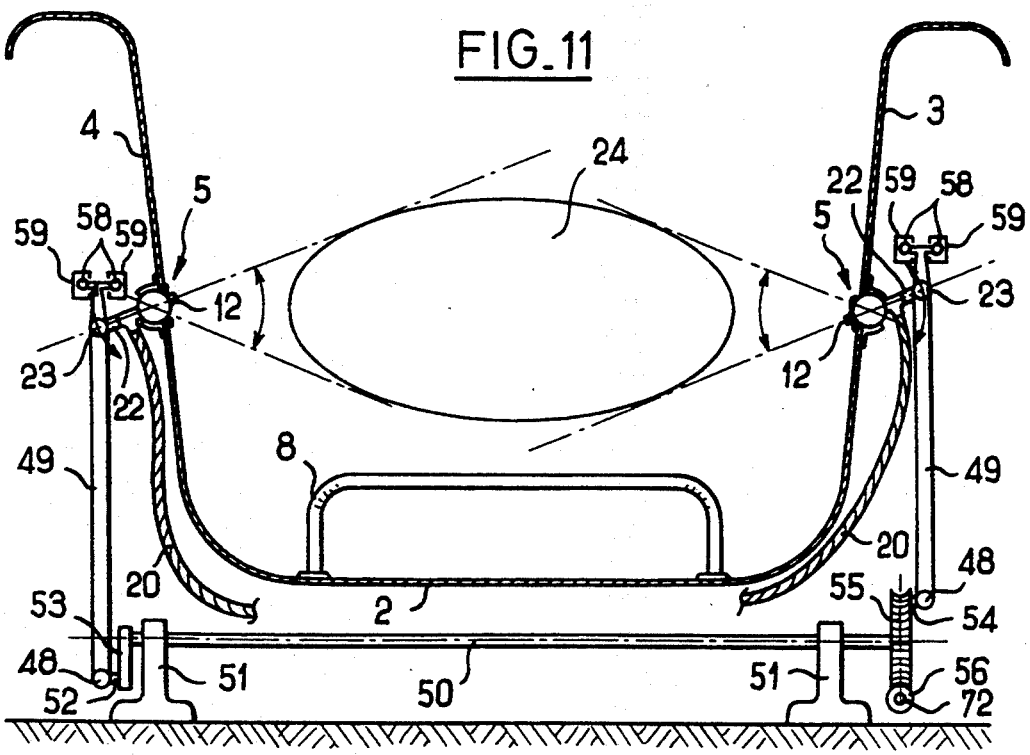
FIG. 11 is a transverse sectional view of another embodiment of the invention.
Figure 12:
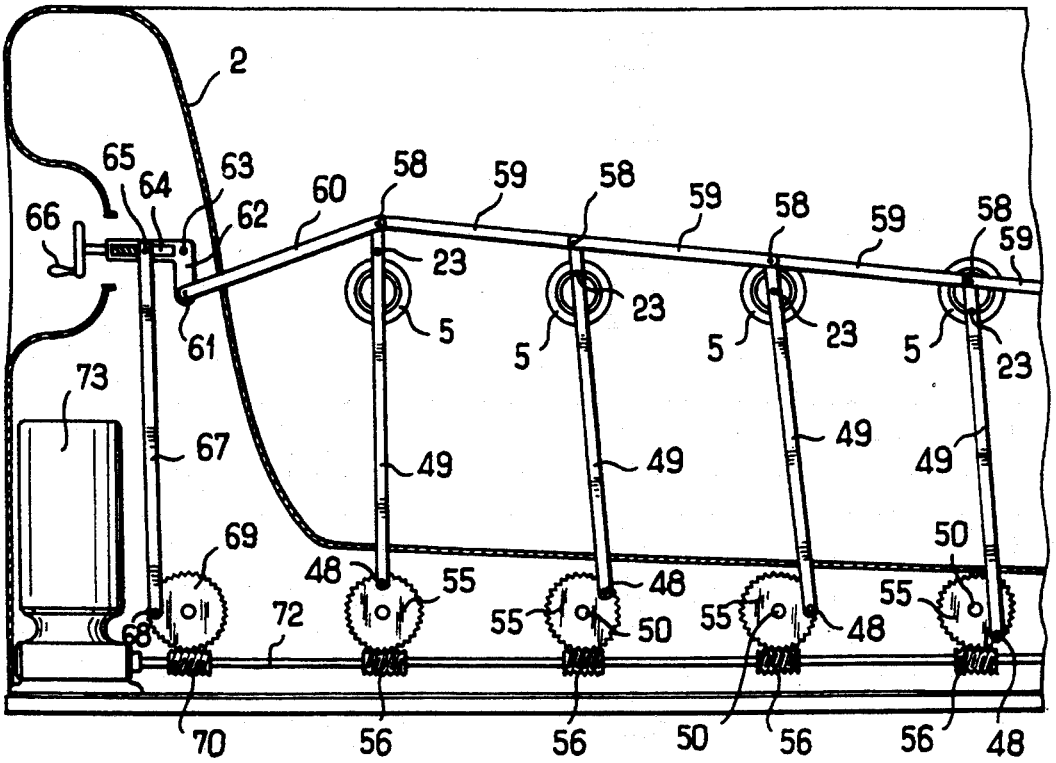
FIG. 12 is a view in partial elevation of the embodiment shown in FIG. 11.

In the embodiment of the invention illustrated in FIGS. 11 and 12, the link transmission mechanism comprises, for each pair of orientable injectors situated on either side of the bathtub 2, a rotary shaft 50 pivotably mounted on fixed bearings 51. The two links 49 are articulated to the rotary shaft 50 by swivel joints 48 situated eccentrically relative to the rotary shaft 50. At one end of the rotary shaft 50, the swivel joint 48 is carried by an eccentric finger 52 situated at the end of a crank arm 53. At the other end of the rotary shaft 50, the swivel joint 48 is carried by an eccentric finger 54 situated on a toothed annulus 55 coaxial with the rotary shaft 50. The toothed annulus 55 meshes with a helicoidal motor pinion 56.

Rotation of the motor pinion 56 thus drives the up-and-down movement of the links 49 to orient in a synchronized manner the hydrodynamic jets produced by the injectors 12. To be compatible with the kinematics of this system, the articulation 23 between the upper end of the link 49 and the rear shank 22 of the injector 12 must be a swivel joint.

The link 49 extends beyond the swivel joint 23 and its upper end comprises two other swivel joints 58 on which are articulated connecting rods 59. The connecting rods 59 connect two-by-two adjacent links situated on the same side of the bathtub 2. The links 49 are thus connected in a chain by the connecting rods 59. At one of the longitudinal ends of the bathtub 2 (see FIG. 12), and at each side of the bathtub 2, a control link 60 is articulated to one of the swivel joints 58 of the first link 49. The other ends of the control links 60 are articulated by swivel joints on a transverse bar 31 perpendicular to the longitudinal direction of the bathtub 2 and extending over substantially the entire width of the bathtub. Near to the side of the bathtub 2 where the motor pinions 56 are located, the transverse bar 61 is articulated to a bent lever 62, itself articulated on a fixed shaft 63 parallel to the transverse bar 61. The articulation shaft 63 of the bent lever 62 is situated substantially at the level of the bend or elbow of the lever 62. The other arm of the bent lever 62 comprises a slide 64 in which may slide a horizontal shaft 65 parallel to the articulation shaft 63 of the bent lever 62. The position of the shaft 65 along the slide 64 may be adjusted by a crank 66 accessible from outside the bathtub 2. A second control link 67 is articulated at its upper end on the shaft 65 disposed in the slide 64 and at its lower end on a finger 68 mounted eccentrically on a toothed annulus 69. A helicoidal motor pinion 70 meshes with the toothed annulus 69. Rotation of the helicoidal motor pinion 70 thus causes an up-and-down movement of the second control link 67 which is transmitted to the first control link 60 through the intermediary of the bent lever 62. The back-and-forth motion of the first control link 60 is transmitted by the set of links 49 of the transmission mechanism through the intermediary of the connecting rods 59 which are displaced in a back-and-forth manner substantially parallel to the longitudinal direction of the bathtub 2. The orientable injectors 12 thus have a sweeping motion having a component in a horizontal plane. The amplitude of this horizontal sweeping component may be adjusted by manipulating the crank 66 so as to displace the shaft 65 in the slide 64 of the bent lever 62.

As is shown in FIG. 12, the motor pinion 70 providing the horizontal component of the sweeping motions and all the motor pinions 56 providing the vertical components of the sweeping motions are mounted on a common motor shaft 72, such that the different sweeping components may be applied simultaneously. The motor shaft 72 may be driven by a hydraulic motor-reducer operating under the water pressure of the pump used for the injectors.

FIG. 12 also shows that there is an angular phase displacement between the instantaneous positions of the eccentric swivel joints 48 relative to the various pairs of orientable injectors 12. In this case, the orientable injectors 12 disposed in a series on the same lateral surface 3, 4 of the bathtub have different vertical components at each instance. This disposition permits obtaining a variation of the orientation of the hydrodynamic jets directed interiorly of the bathtub 2 that is both temporal (owing to the sweeping motion) and spatial. The variety of the hydrodynamic massages that can be performed is therefore very great.

Figure 13:
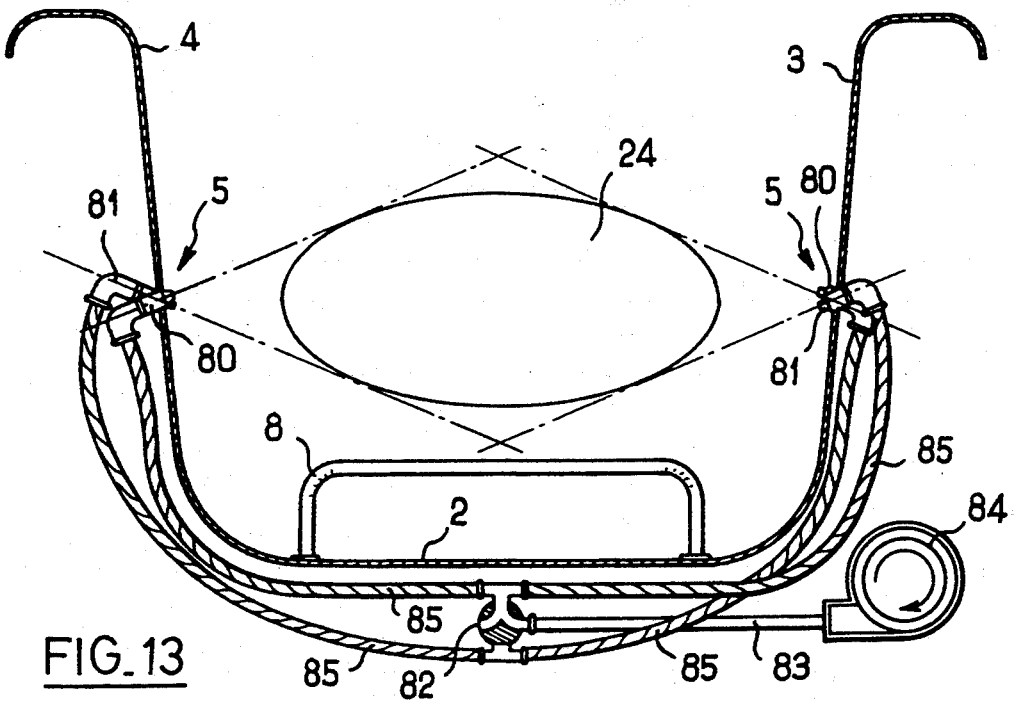
FIG. 13 is a transverse sectional view of a fourth embodiment of the invention.

A simplified embodiment of the invention is shown in FIG. 13. In this simplified embodiment, two fixed injectors 80, 81 are mounted with different fixed orientations in each injection orifice 5 situated on a side surface 3, 4 of the bathtub 2. One of the injectors 80 is directed upwardly such that the corresponding hydrodynamic jet is directed toward the surface of the water situated in the bathtub 2, above the body 24 of the patient. The other injector 81 is directed downwardly such that the corresponding hydrodynamic jet is directed toward the bottom of the bathtub 2, beneath the body 24 of the patient. As in the previously described examples, the injection orifices 5 situated on either side of the bathtub 2 symmetrically relative to the longitudinal direction of the bathtub 2 are associated in pairs. To each pair of injection orifices 5 corresponds a three-way valve 82 whose inlet is connected to a supply tube 83 connected to the pump 84. One of the outlets of the three-way valve 82 is connected to two flexible tubes 85 whose ends are respectively connected to an upwardly directed injector 80 situated on one side surface 4 of the bathtub 2 and to a downwardly directed injector 81 situated on the opposed side surface 3 of the bathtub 2. The second outlet of the three-way valve 82 is connected to two flexible tubes 85 respectively connected to the downwardly oriented injector 81 situated on the first side surface 4 of the bathtub 2 and the upwardly directed injector 80 situated on the opposed side surface 3 of the bathtub 2. By controlling the position of the three-way valve 82, the supply tube 83 is selectively placed in communication with two injectors 80, 81 situated on the opposed side surface 3, 4 of the bathtub 2, one of these injectors 80 being oriented upwardly and the other of these injectors 81 being oriented downwardly. By alternating the positions of the three-way valve, hydrodynamic rolling motions are successively produced in the two directions in the water of the bathtub 2.

The three-way valve 82 is preferably hydraulically or pneumatically controlled for reasons of electric isolation.

In the above description, several embodiments of the present invention have been presented to permit the person skilled in the art to reproduce the same and to show that the invention may take various forms.

However, it will be understood that other variations may be made to the described embodiments without departing from the scope of the present invention.

I claim:

1. Hydrodynamic massage device, comprising an elongated bathtub having opposed side surfaces, a plurality of injection orifices having corresponding movable injectors disposed on said opposed side surfaces and operatively associated with fluid supply means for producing orientable hydrodynamic jets directed interiorly of the bathtub, and control means for orienting in a synchronized manner the hydrodynamic jets issuing from the injection orifices, said control means being arranged such that, when a hydrodynamic jet issuing from an injection orifice disposed on one side surface of the bathtub is oriented upwardly, the control means simultaneously orients downwardly a hydrodynamic jet issuing from an injection orifice disposed on the opposed side surface of the bathtub, and vice versa.

2. Device according to claim 1, wherein each hydrodynamic jet oriented by the control means remains substantially parallel to a respective vertical plane.

3. Device according to claim 2, wherein the vertical planes are inclined relative to the longitudinal direction of the bathtub, such that the hydrodynamic jets oriented by the control means are directed interiorly of the bathtub and toward the side where in use, the head of a patient stretched out in the bathtub is situated.

4. Device according to claim 1, wherein the orientable injectors are positioned in the injection orifices disposed on the opposed side surfaces of the bathtub.

5. Device according to claim 4, wherein the orientable injectors are positioned in the injection orifices by sealed swivel joint mountings.

6. Device according to claim 4, wherein the control means comprise an articulated transmission mechanism to orient in a synchronized manner the orientable injectors positioned in the injection orifices.

7. Device according to claim 6, wherein the orientable injectors are associated in pairs corresponding to the injection orifices disposed on the opposed side surfaces of the bathtub in a substantially symmetrical manner relative to the longitudinal direction of the bathtub, said transmission mechanism conjugating the orientations of the injectors of each pair such that, when one injector of a pair is oriented upwardly its associated injector is oriented downwardly, and vice versa.

8. Device according to claim 6, wherein the transmission mechanism comprises links disposed behind the opposed side surfaces of the bathtub, each link having one end articulated to the rear of an orientable injector and another end articulated to a transmission device extending transversely to the longitudinal direction of the bathtub so as to synchronize the orientations of the injectors on which are articulated the links, said control means further comprising actuating means for applying up-and-down movements to the links.

9. Device according to claim 8, wherein the transmission device is a lever mounted on a central shaft parallel to the longitudinal direction of the bathtub.

10. Device according to claim 8, wherein the transmission device is a rotary shaft having two links articulated in two eccentric positions to the ends of the rotary shaft, and the actuating means applies a rotary movement to the rotary shaft.

11. Device according to claim 8, wherein the transmission means further comprise at least one connecting device articulated to the links situated on the same side of the bathtub, and said control means further comprise means for displacing in a back-and-forth motion the connecting device substantially parallel to the longitudinal direction of the bathtub.

12. Device according to claim 11, further including means for adjusting the amplitude of the back-and-forth movement of the connecting device.

13. Hydrodynamic massage device, comprising an elongated bathtub having opposed side surfaces, a plurality of injection orifices disposed on said opposed side surfaces and operatively associated with fluid supply means for producing hydrodynamic jets directed interiorly of the bathtub, and control means for orienting in a synchronized manner the hydrodynamic jets issuing from the injection orifices, said supply means comprising for each injection orifice situated on an opposed side surface of the bathtub, at least two fixed injectors of different orientations, and said control means being arranged such that, when a hydrodynamic jet issuing from an injection orifice disposed on one side surface of the bathtub is oriented upwardly, the control means simultaneously produces a downwardly oriented hydrodynamic jet issuing from an injection orifice disposed on the opposed side surface of the bathtub, and vice versa.

14. Device according to claim 13, wherein the control means comprise selection means for selectively controlling the flow of fluid into one of the fixed injectors of each injection orifice.

15. Device according to claim 14, wherein the selection means comprise a fluidically controlled three-way valve having an inlet and two outlets, each outlet being connected both to an upwardly oriented fixed injector disposed on one side surface of the bathtub and to a downwardly oriented fixed injector disposed on the opposed side surface of the bathtub.

* * * * *